US007631409B2

(12) United States Patent
Dehlsen

(10) Patent No.: US 7,631,409 B2
(45) Date of Patent: Dec. 15, 2009

(54) METHOD OF BATCH ASSEMBLY OF TEMPORARY FENCE PANELS AND ANCHOR BLOCKS

(75) Inventor: Brian Dehlsen, Rydalmere (AU)

(73) Assignee: Kelvindale Products Pty. Ltd., Rydalmere, NSW (AU)

( * ) Notice: Subject to any disclaimer, the term of this patent is extended or adjusted under 35 U.S.C. 154(b) by 0 days.

(21) Appl. No.: 11/729,106

(22) Filed: Mar. 28, 2007

(65) Prior Publication Data

US 2008/0237560 A1 Oct. 2, 2008

(51) Int. Cl.
*B23P 11/00* (2006.01)
*E04H 17/14* (2006.01)

(52) U.S. Cl. ..... 29/428; 29/525.01; 29/527.1; 256/24

(58) Field of Classification Search ..... 29/428, 29/525.01, 527.1, 897; 256/1, 24, 65.14; 264/250

See application file for complete search history.

(56) References Cited

U.S. PATENT DOCUMENTS 4,255,913 A 3/1981 Poma

2008/0172970 A1* 7/2008 MacDonald et al. ..... 52/574

FOREIGN PATENT DOCUMENTS

| | | |
|---|---|---|
| AU | 2002301692 | 7/2003 |
| AU | 2004208695 A1 | 3/2005 |
| GB | 2360301 | 9/2001 |
| JP | 08-144297 | 6/1996 |
| NL | 9401555 A | 5/1996 |
| NZ | 517340 | 1/2003 |

* cited by examiner

*Primary Examiner*—Jermie E Cozart
(74) *Attorney, Agent, or Firm*—Stetina Brunda Garred & Brucker; Lowell Anderson

(57) ABSTRACT

The disclosure is of a method of batch assembly of temporary fence panels and anchor blocks of a temporary fence in which shells of anchor blocks for support of temporary fence panel posts are manufactured at a first location, with manufacture at a second location fence panels having posts adapted for insertion into the anchor blocks. The shells are filled with a settable material, such as concrete. Each anchor block comprises a base block and a superposed insert block. The required number of filled shells and fence panels is assembled for transport to a location for assembly into a temporary fence.

20 Claims, 8 Drawing Sheets

METHOD OF BATCH ASSEMBLY OF TEMPORARY FENCE PANELS AND ANCHOR BLOCKS

The present invention relates to temporary fences such as typically found at building sites and, more particularly to the base or anchor blocks with apertures into which the uprights of panels of such fences may be inserted and so supported.

BACKGROUND

The use of temporary fences made up of panels comprising pairs of uprights and stringers with infills of woven wire mesh, supported in concrete blocks, has become a common feature of building sites and other areas requiring temporary enclosure. In this arrangement, the anchor blocks are provided with one or more apertures into which the adjacent uprights or stiles of a pair of adjoining panels can be inserted.

To be effective in supporting the substantial weight of the fence panels and resisting the forces such as wind loading, which may be applied to them, the anchor blocks themselves must be of substantial size and weight, preferably at least 35 Kg. This places them outside the permitted maximum weight, which in some jurisdictions at least, may be lifted by a male person due to health and safety issues.

Two-part anchor blocks are known. Thus for example, a Dutch patent NL940155 discloses as one embodiment two interlocking anchor blocks arranged end to end; each block comprising a shell filled with concrete. A disadvantage of this arrangement is that each of the stiles of two adjacent fence panels is supported within one only of the pair of anchor blocks (when inserted into the central pair of apertures) so that with free sliding movement between the interlocking parts, there is likely to be reduced stability of the fence when subjected to lateral loading.

Another known two-part anchor block is disclosed in Australian patent application AU 2004208695. These blocks (also comprising plastic shells filled with concrete) are arranged side by side, with each block provided with a metal hoop; the two hoops located one above the other when the blocks are assembled, to form a rectangular aperture into which the adjoining stiles are inserted. It is only when a pair of adjoining uprights are inserted through the common aperture provided by these hoops that separation of the two parts of the block is prevented.

Apart from the complexity of manufacture, a particular disadvantage in use of this arrangement is that the panels at the ends of a temporary fence will be very poorly supported, since a single upright inserted through the aperture of the hoops, which are adapted to hold two uprights, will not be secured.

A further disadvantage of both the above disclosures of the prior art, lies in the fact that, particularly in the case of AU2004208695, the anchor blocks are unsuitable for acting as hinges or bearings when it is desired to operate one or a pair of panels of the temporary fence as an access gate.

Nor is there any provision in either of the pairs of anchor blocks of these prior art disclosures, for additional securing means; both relying purely on the mass of the blocks to maintain the fence in an upright position.

It is an object of the present invention to address or at least ameliorate some of the above disadvantages.

Note

The term "comprising" (and grammatical variations thereof) is used in this specification in the inclusive sense of "having" or "including", and not in the exclusive sense of "consisting only of".

BRIEF DESCRIPTION OF INVENTION

Accordingly, in a first broad form of the invention, there is provided an anchor assembly for a temporary fence; said assembly comprising a base portion and a superposed insert portion; each said base portion and said superposed insert portion comprising a composite of a shell open at the underside, and a settable material filling said shell; and wherein respective pairs of formers integral to each said shell of said base portion and said superposed portion, define substantially vertical pairs of passages through said base portion and said superposed insert portion; said passages arranged so that when said base portion and said superposed insert portion are assembled together, respective pairs of said passages are in vertical alignment; said passages adapted for receiving therethrough respective ends of uprights of adjacent panels of said temporary fence; said ends passing through both said superposed insert portion and said base portion.

Preferably, said shell of said base portion includes a generally rectangular prism having an open rectangular base with side and end portions extending upwardly to an upper surface parallel to said rectangular base; said shell further including corner projections thrusting upwardly from said upper surface.

Preferably, said upper surface is provided with a pair of apertures disposed along a transverse centre line of said upper surface; each of said pair of apertures communicating with a respective integral former extending downwardly from an underside of said upper surface to a point approximately level with said open rectangular base.

Preferably, each said former is provided with an integral closure at said point level with said open rectangular base; said closure provided with a drainage hole.

Preferably, each of said pair of apertures and respective said formers are adapted for insertion therein as a close sliding fit, of a tubular steel upright of temporary fence panel.

Preferably, each end portion of said open rectangular base is provided with a recess extending inwardly; said recess open at an underside level with said open rectangular base; said recess extending upwardly to a level intermediate said open rectangular base and said upper surface; said recess adapted for insertion of the fingers of a user for lifting of said base portion.

Preferably, apertures are provided in each said end portion; said apertures located centrally in said end portion and between said level intermediate said open rectangular base and said upper surface; said apertures communicating with integral formers extending inwardly from each said end portion such that axes of said formers are aligned; each said former coextensive in length with each said recess.

Preferably, each said aperture and each said former is adapted to receive therethrough a length of reinforcing rod passing from one said end portion to an opposite said end portion.

Preferably, each one of at least one pair of diametrically opposed said corner projections is provided with an aperture in an upper surface of said corner projections; said aperture communicating with an integral former extending downwardly from said upper surface to a point level with said open rectangular base; said aperture and said former adapted to receive therethrough securing pegs.

Preferably, each of said securing pegs comprises a welded "T" shaped assembly of lengths of steel rod; the length of a leg portion of said "T" shaped assembly sufficient to extend from said upper surface of said corner projections to a preferred depth be low a ground surface supporting said anchor assembly; the length of a cross bar portion of said "T" shaped assembly sufficient for one side of said cross bar to overlap a portion of said superposed insert portion when said securing peg is driven to said preferred depth.

Preferably, said superposed insert portion comprises a central body portion with outwardly extending opposing outer end portions; said central body portion and said outwardly extending end portions having a contiguous upper surface parallel to an underside of said central body portion; said superposed insert portion adapted for nested engagement as a close sliding fit between said corner projections of said base portion so as to rest on said upper surface of said base portion; said base portion and said superposed insert portion when assembled forming a generally rectangular block.

Preferably, depth of said central body portion is approximately equal to height of said corner projections; and wherein depth of said opposing outer end portions is reduced relative to said central body portion so as to allow space for insertion of the fingers of a user when lifting said superposed insert portion for assembly or disassembly with said base portion.

Preferably, said upper surface of said superposed insert portion is provided with a pair of apertures disposed along a transverse centre line of said upper surface; said apertures communicating with integral formers extending downwardly from an underside of said upper surface to a point level with said underside of said central body portion; respective ones of said apertures and said formers axially aligned with respective ones of said apertures and said formers of said base portion when said base portion and said superposed insert portion are assembled together, such that said apertures and said formers define a single pair of passages passing through both said superposed insert portion and said base portion.

Preferably, each of said outer end portions is provided with an aperture; each said aperture communicating with an integral former extending inwardly from each said outer end portion such that said formers are axially aligned; each said former coextensive in length with respective said outer end portions.

Preferably, each said aperture and said former of said outer end portions is adapted to receive therethrough a length of reinforcing rod extending from one said outer end portion to an opposite said outer end portion.

Preferably, said settable material is concrete.

Preferably, said base portion has a weight when filled with said settable material in a range of 18 to 24 kilograms.

Preferably, said superposed insert portion has a weight when filled with said settable material in a range of 14 to 20 kilograms.

In a further broad form of the invention, there is provided a method for providing an anchor assembly for a temporary fence comprising a base portion and a superposed insert portion; said method including the steps of:

a. Injection moulding or otherwise forming a plastic shell open at an underside, for each of said base portion and said superposed insert portion, b. inverting each shell of said base portion and said superposed insert portion, c. inserting a length of reinforcing rod through apertures and formers extending inwardly from opposing end portions of each of said base portion and said superposed insert portion, d. pouring said settable material into each of said shells so as to fill each of said shells level with respective said open undersides, e. allowing said settable material to harden, f. inverting each of said base portion and superposed insert portion and placing said superposed insert portion onto said first base portion.

Preferably, said settable material is concrete.

Preferably, said method further includes the steps of:

a. providing "T" shaped securing pegs, b. inserting legs of said "T" shaped securing pegs through apertures and formers provided in at least one pair of opposing corner projections of said base portion, c. driving said pegs through said apertures and said formers to a preferred depth so as to lock said superposed insert portion in a nested position on said base portion by an overlapping of ends of cross bars of said "T" shaped securing with said superposed insert portion.

In a further broad form of the invention there is a provided a method of batch assembly of temporary fence panels comprising:

a) Manufacturing at a first location shells adapted for receipt of temporary fence panel posts therein b) Manufacturing at a second location fence panels having posts adapted for insertion into said shells c) Receiving said shells at said second location and filling said shells with settable material d) Matching predetermined numbers of said shells filled with settable material with predetermined numbers of panels thereby to form a batch matching an order for a predetermined length of temporary fence panel e) Loading said batch on transport and transporting said batch to a remote location where said length of temporary fence panel is assembled by insertion of said posts of said panels into ones of said shells filled with settable material.

Preferably said shells comprise a base portion and a superposed insert portion.

BRIEF DESCRIPTION OF DRAWINGS

Embodiments of the present invention will now be described with reference to the accompanying drawings wherein.

DETAILED DESCRIPTION OF PREFERRED EMBODIMENTS

Figure 1:
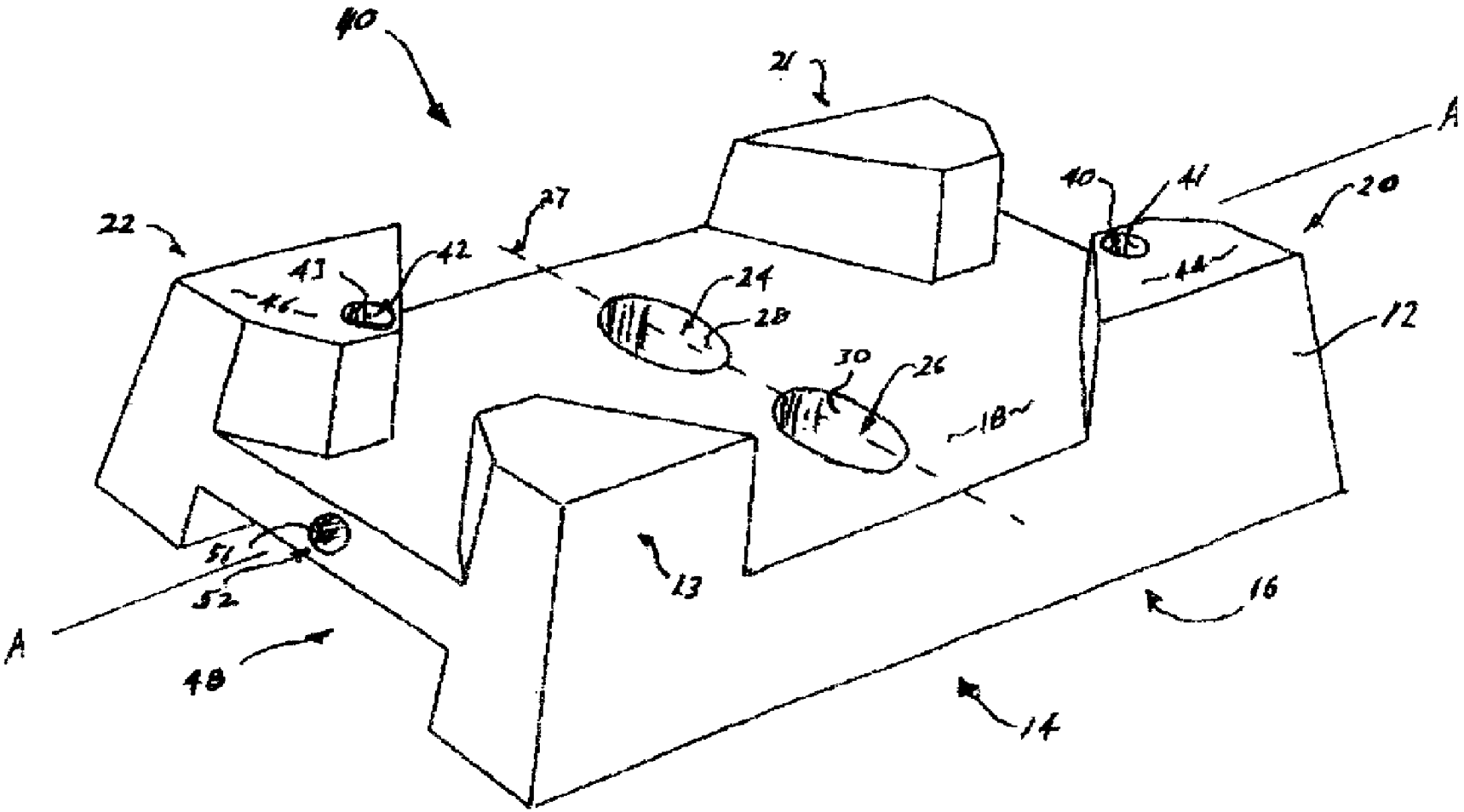
FIG. 1 is a perspective view of a base portion of a fence base according to a preferred embodiment of the present invention.
Figure 2:
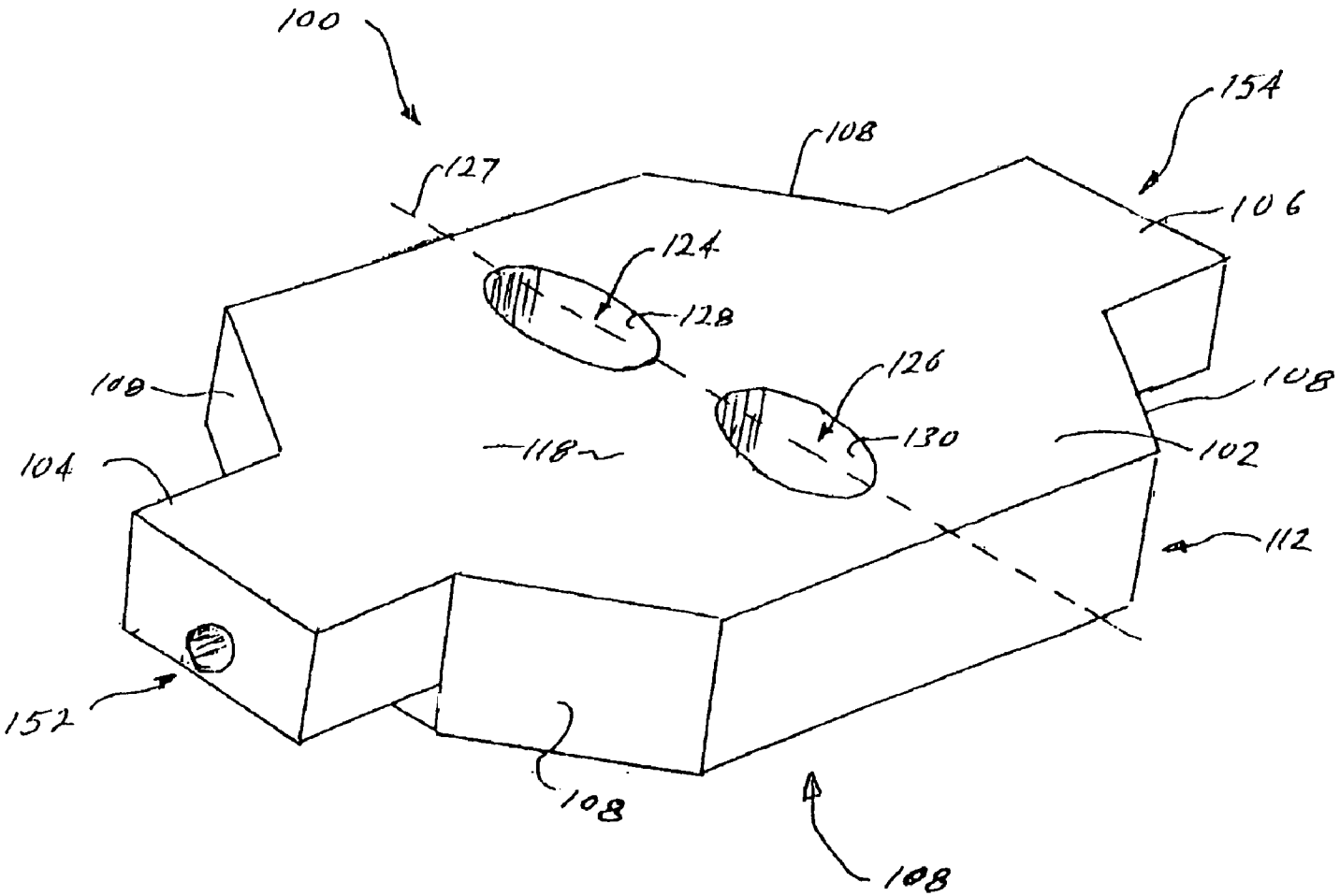
FIG. 2 is a perspective view of a superposed insert portion of the preferred embodiment of a fence base.

With reference to FIG. 1, a base portion 10 of a fence base is comprised of a shell 12 moulded in some suitable plastic. Shell 12 is formed as a generally rectangular prism having a rectangular base 14 open at its underside 16 as may be seen from the view from below of FIG. 6.

Shell 12 has an upper surface 18 parallel with rectangular base 14. The sides of shell 12 preferably taper inwardly to some extent as can best be seen in the side elevation and end elevation views of FIGS. 4 and 7. Projecting upwardly at each corner area of upper surface 18, are projections 20 to 23. Upper surface 18 is provided with apertures 24 and 26 arranged side by side and disposed along the transverse centre line 27 of upper surface 18.

Figures 4, 5, 6, 7, 8, 9:
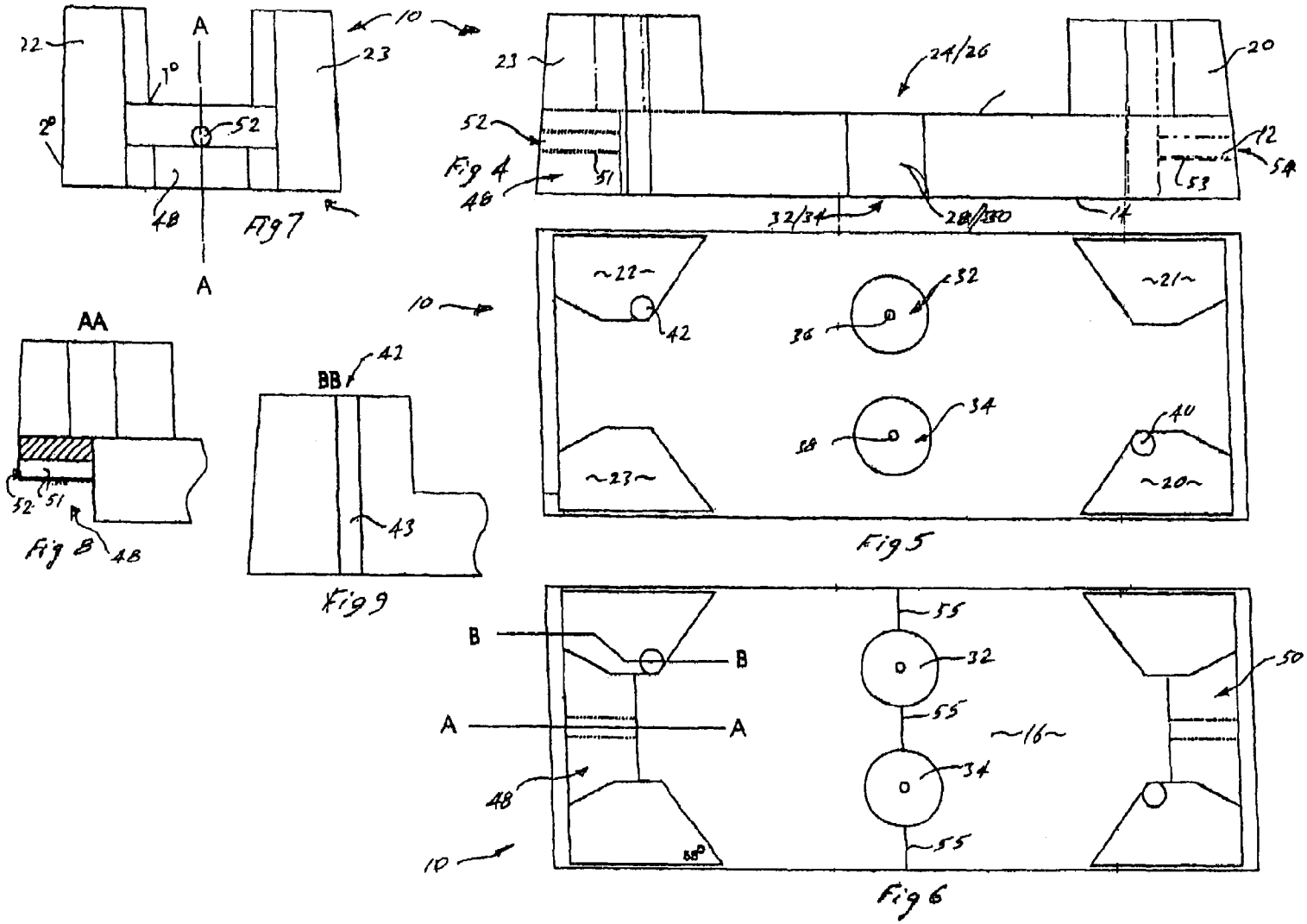
FIG. 4 is a side elevation view of the base portion of FIG. 1
FIG. 5 is a plan view of the base portion of FIG. 1.
FIG. 6 is a view from underneath the base portion of FIG. 1
FIG. 7 is an end elevation view of the base portion of FIG. 1.
FIG. 8 is a sectioned view of a portion of the base portion of FIG. 1 taken along the line A-A.
FIG. 9 is a sectioned view of a portion of the base portion of FIG. 1 taken along the line B-B.
Figure 10:
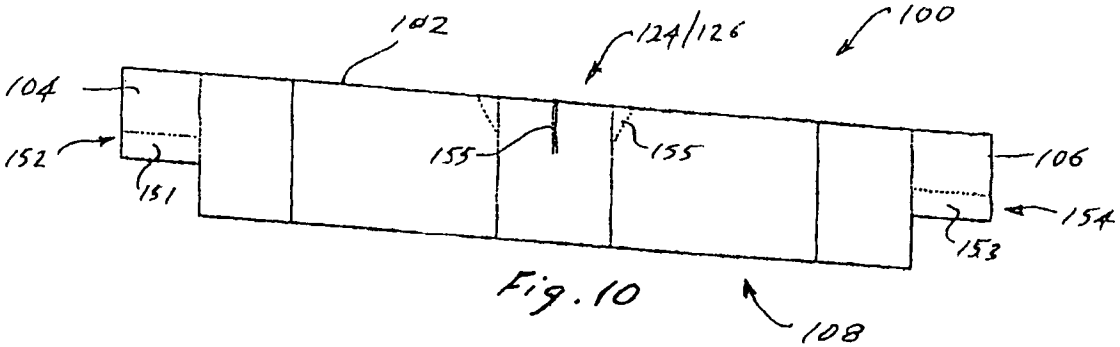
FIG. 10 is a side elevation view of the superposed insert portion of FIG. 2.
Figure 11:
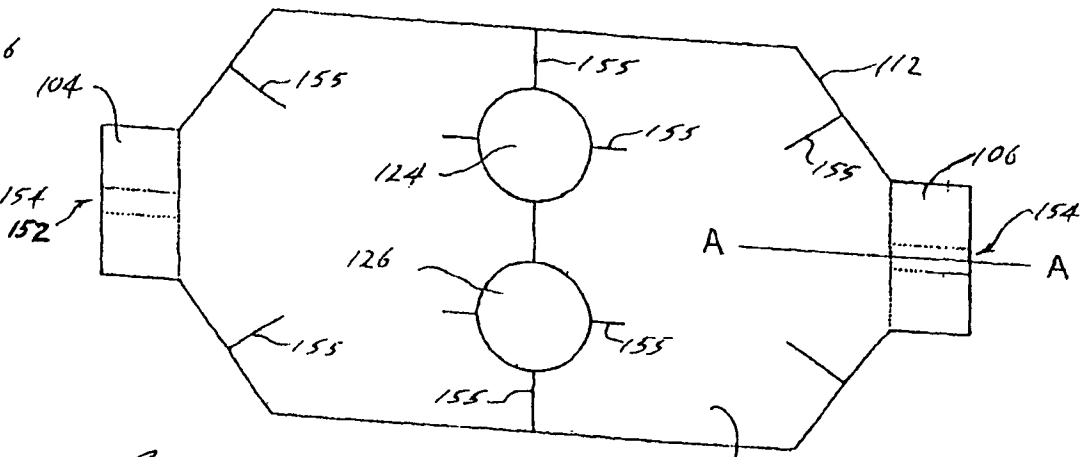
FIG. 11 is a view of the underneath of the superposed insert portion of FIG. 2.
Figure 12:
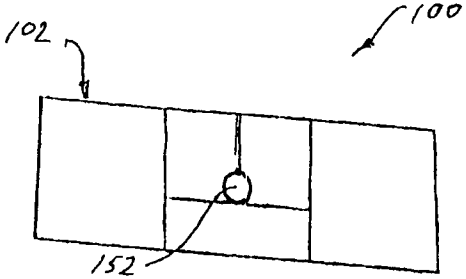
FIG. 12 is an end elevation view of the superposed insert portion of FIG. 2.
Figure 13:
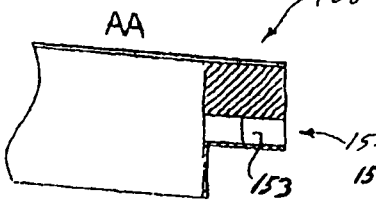
FIG. 13 is a sectioned view of a portion of the superposed insert portion of FIG. 2 taken along the line A-A.

Apertures 24 and 26 communicate with formers 28 and 30 respectively, integrally moulded with shell 12 and extending downwardly from the underside of upper surface 18 to the level of rectangular base 14 as best seen in the hidden detail of FIG. 4. Formers 28 and 30 are preferably closed at their lower ends 32 and 34 except for small drainage holes 36 and 38. The separation between the axes of formers 28 and 30 is arranged to equal that of the axes of adjoining uprights of adjacent temporary fence panels when these are linked towards their upper end by a connecting bracket (not shown).

Preferably, though not essentially, formers 28 and 30 are cylindrical and have bores such as to accept therethrough the tubular steel uprights typically employed in temporary fence panels. It will however be appreciated by those skilled in the art that other shapes of formers 28 and 30 can be envisaged, such as square or hexagonal for example, sized so that sides of the square or hexagonal tubes of the formers tangentially contact the cylindrical surfaces of the tubular uprights.

With reference again to FIG. 1, at least one pair of diametrically opposed projections, such as 20 and 22, may further be provided with apertures 40 and 42 respectively, each of which communicates with formers 41 and 43 respectively, also integrally moulded with shell 12 and extending downwardly from the undersides of the upper surfaces 44 and 46 to the level of rectangular base 14 as can be seen in FIG. 9. Formers 41 and 43 are open at their lower ends and are sized so as to accept pegs 13 which may be inserted into the apertures and driven into the ground to assist in stabilising the base portion 10 once in situ.

Formers 41 and 43 also are preferably though not necessarily cylindrical in form, and may also be of square or hexagonal section for example. Formers 41 and 43 are preferably moulded so as to have outer walls of the formers contiguous with, and thus supported by internal surfaces of corner projections 20 and 22 respectively.

Figure 3:
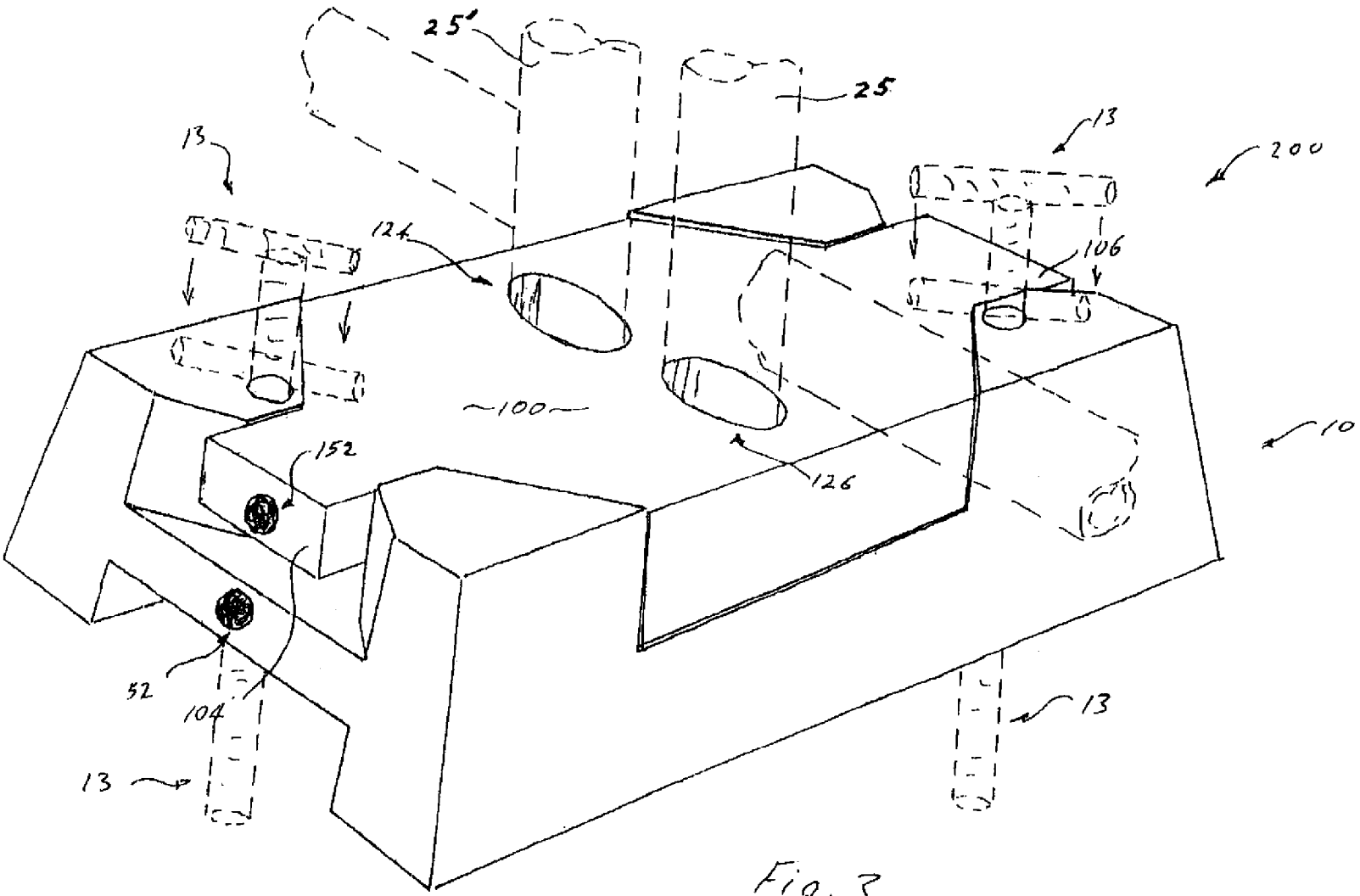
FIG. 3 is a perspective view of the base portion and superposed insert portion of FIGS. 1 and 2 when assembled for use.

The pegs 13 shown in FIG. 3, preferred for use with the anchor assembly of the invention, are preferably formed as a "T" shaped assembly of two steel rods, with one length of rod forming the leg and another the cross bar. This arrangement allows one or two such pegs to be inserted through the formers 41 and 43 and driven into the ground so that, when fully driven "home", one end of a peg's cross bar projects over the superposed insert portion 100 described below, and leg of the "T" shaped assembly extends below the ground surface to a preferred depth. As well as adding stability to the anchor assemblies, particularly where a fence is erected on sandy, soft or sloping ground, this has the advantage of assisting in locking the two parts of the anchor assembly together.

With reference to FIGS. 1, 6, 7 and 8, it will be seen that recesses 48 and 50 are provided at each end of the base portion 10. These extend inwardly sufficient to provide handgrips for a user to lift the base portion off, or place it onto, a surface. Recesses 48 and 50 are open at their underside and extend upwardly to a level intermediate between base 14 and upper surface 18. Positioned centrally, in the portions of the ends of shell 12 between recesses 48 and 50 and upper surface 18, are apertures 52 and 54 communicating with cylindrical formers 51 and 53 respectively, arranged so that formers 51 and 53 are axially aligned.

As may be seen in FIG. 6, strengthening webs 55 may be provided to maintain correct alignment of formers 28 and 30 prior to the filling of shell 12 with a settable material. Formers 51 and 53 are adapted for insertion therethrough of a length of reinforcing rod (not shown) prior to filling with a settable material in order to assist in retaining the material securely within shell 12.

Turning now to FIGS. 2 and 10 to 13, a superposed insert portion 100 of the anchor assembly of the present invention, is comprised of a central body portion 118 and outwardly extending portions 104 and 106 forming a shell 112. Central body portion 118 is open at its underside 108 and its depth may be approximately equal to, or less than the height of projections 20 to 23 of base portion 10. The depth of extending portions 104 and 106 however, is sufficiently less than that of central body portion 118 to allow a user (not shown) to insert his or her fingers under portions 104 and 106 for lifting superposed insert portion 100 onto or off base portion 10, or placing it onto a surface.

The shape of outwardly extending portions 104 and 106 and of shoulder portions 108 is such as to allow a close nesting of superposed insert portion 100 between projections 20 to 23 of base portion 10, as may be seen in FIG. 3. Superposed insert portion 100 is also provided with a pair of apertures 124 and 126 disposed along the transverse centre line 127 of central body portion 118. Apertures 124 and 126 communicated with formers 128 and 130 respectively, which extend downwardly from the underside of the upper surface of central body portion 118 to a point level with the underside 108. Again, these formers 128 and 130 are preferably cylindrical but may be formed as any regular polygon, four sided or six sided for example. However unlike the formers 28 and 30 of base portion 10, formers 128 and 130 are open at their lower ends.

Pairs of apertures 124 and 126 and their respective formers 128 and 130 are positioned so as to be aligned vertically with respective apertures 24 and 26 and their corresponding formers 28 and 30 when superposed insert portion 100 is assembled on base portion 10. The apertures and formers are also adapted to accept the insertion of tubular steel upright members 25' and 25 (shown in dashed outline in FIG. 3) of adjoining fence panels. Thus, when superposed insert portion 100 is assembled with base portion 10 in use, the ends of upright members 25' and 25 of adjoining fence panels, pass through both superposed insert portion 100 and base portion 10.

Again with reference to FIGS. 3, 10 and 11, each of outwardly extending portions 104 and 106, is provided with centrally positioned apertures 152 and 154, each of which communicates with respective cylindrical formers 151 and 153 extending approximately the length of portions 104 and 106. Apertures 152 and 154 and formers 151 and 153 are axially aligned and of a diameter so as to allow insertion of a length of reinforcing rod extending from one outer end portion 104 to the other 106.

Figure 14:
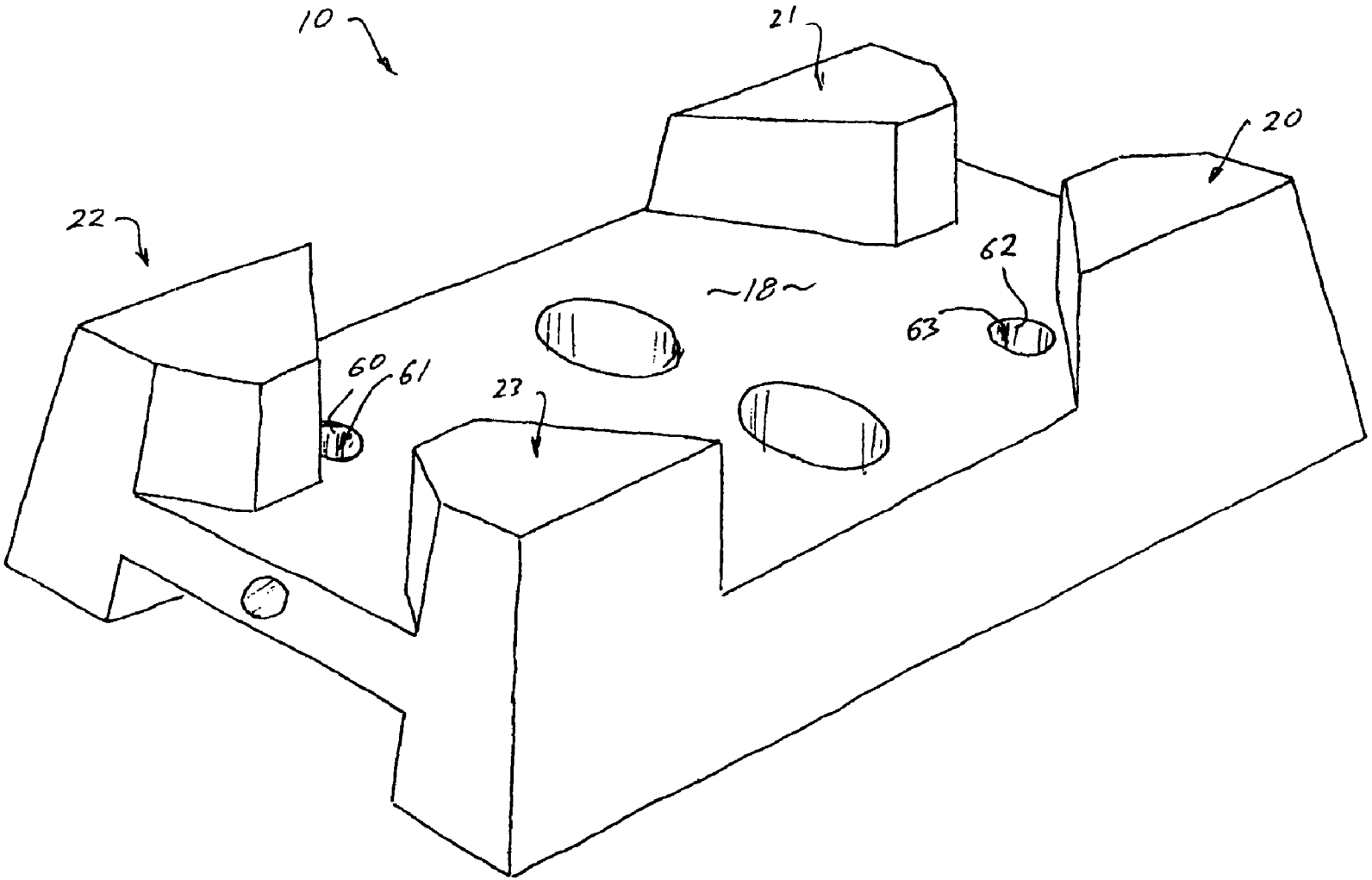
FIG. 14 is a perspective view of a further preferred embodiment of the base portion of FIG. 1.
Figure 15:
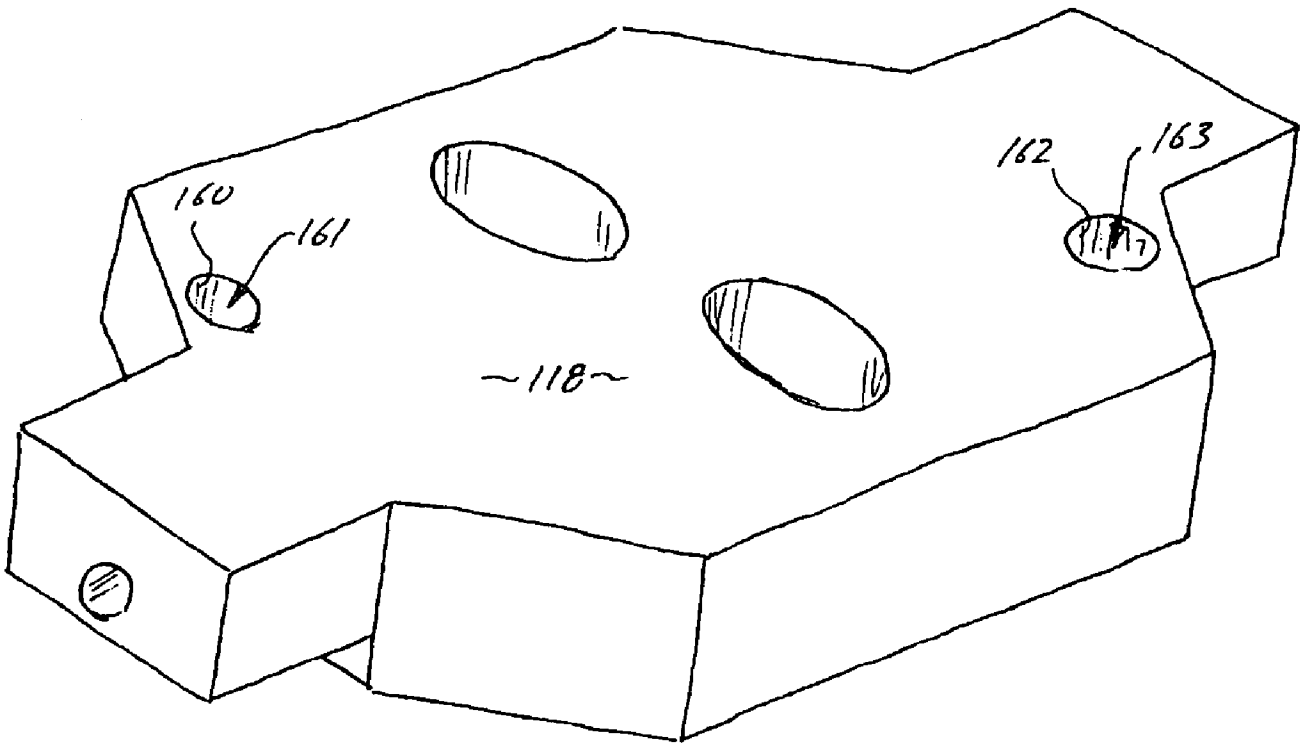
FIG. 15 is a perspective view of a further preferred embodiment of the superposed insert portion of FIG. 2.
Figure 16:
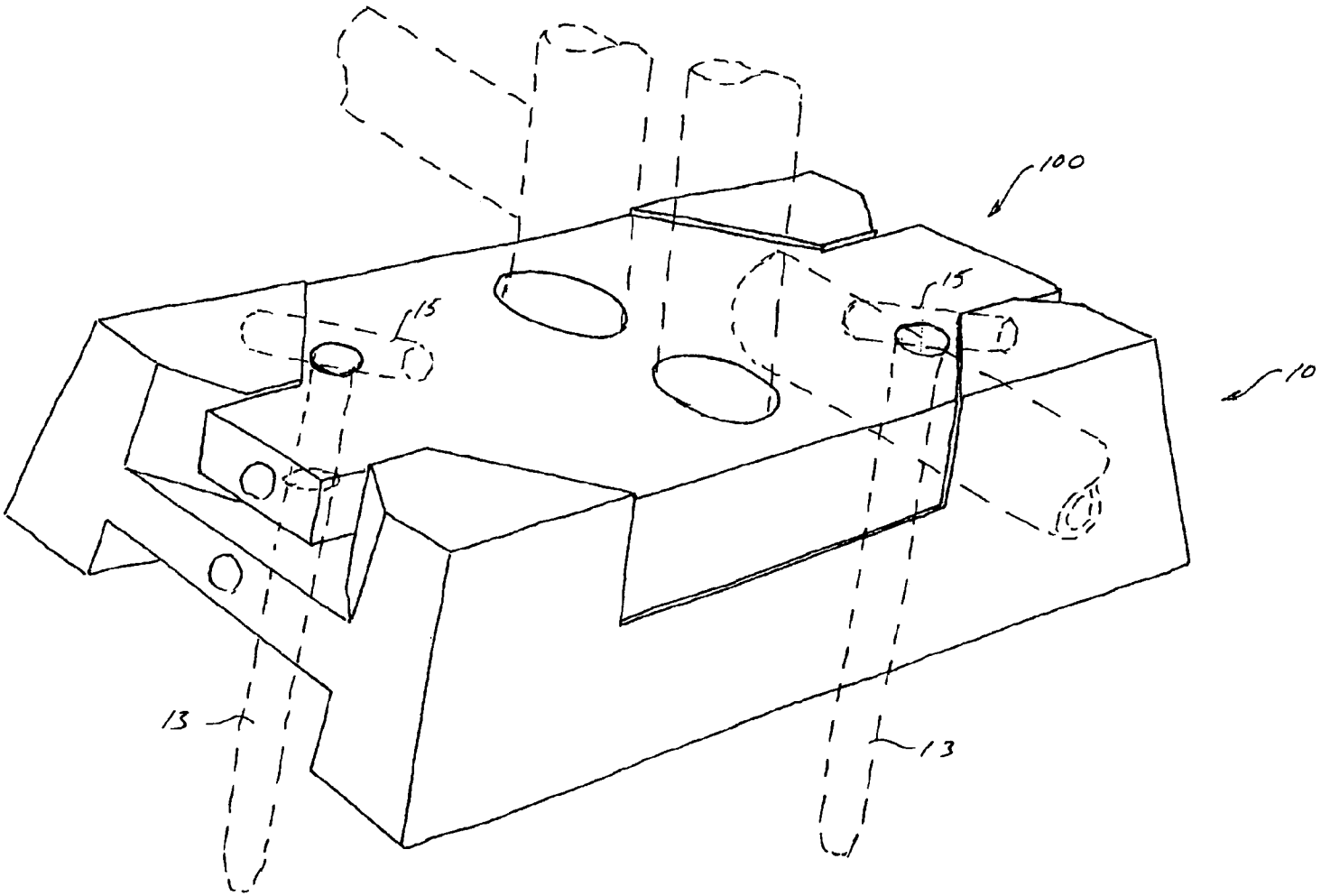
FIG. 16 is a perspective view of the base portion of FIG. 14 and superposed insert portion of FIG. 15 assembled together in use.

In a further preferred embodiment as shown in FIGS. 14, 15 and 16, the shells of base portion 10 and superposed insert portion 100 are configured as previously described. In this embodiment however, both base portion 10 and superposed insert portion 100 are provided with apertures 60, 62 and 160, 162 respectively and associated formers, 61, 63 and 161, 163. For both base portion 10 and superposed insert portion 100, apertures are formed in the upper surfaces 18 and 118 respectively with their respective formers depending from the underside of each upper surface.

The positioning of the apertures and formers is such that those of superposed insert portion 100 are in alignment with respective ones of base portion 10 when the two portions are assembled together, as can be seen in FIG. 16. Thus in this embodiment, securing pegs 13 can be inserted to pass through both the superposed insert portion 100 and base portion 10 and driven into a supporting ground surface. Furthermore, the positioning of the passages so formed by the aligned apertures and associated formers is adjacent projections 20 to 22 such that cross bars 15 of pegs 13, overlap projections 20 and 22 as shown in FIG. 16, thereby in effect securing superposed insert portion 100 to base portion 10.

In manufacture, having injection moulded or otherwise formed the shells 12 and 112, these are inverted and each may optionally be provided with a length of reinforcing rod passing from apertures 52 to 54 and from 152 to 154 respectively. Concrete or some other suitable settable material is then poured into the respective shells until completely filled. After setting of the settable material the portions may be inverted and are ready for use.

At a site where a temporary fence is to be erected, base portions and superposed insert portions may be lifted and positioned individually, thus ensuring that construction personnel are not required to either break health and safety regulations, or run the risk of back injury. Preferred dimensions of the base portion and superposed insert portion herein described when filled with concrete, will result in weights of 20-22 Kg for the base portion and 16-18 Kg for the superposed insert portion.

For a temporary fence anchor made in two parts to be effective, it must when assembled, act as a unitary block when subjected to the typical forces to which a temporary fence is exposed. These forces originate primarily from wind loading, especially when panels are provided with any form of sheeting, as well as impacts from personnel and equipment. Thus any arrangement, which allows lateral movement between the two parts of the assembly, will reduce the stability of the anchor. Such movement is the more likely in arrangements where each of the adjoining uprights of adjacent fence panels only passes through one of the parts making up the anchor.

It will be readily understood that in the anchor assembly 200 of the present invention, the close nesting of superposed insert portion 100 between the upward projections 20 to 23 of base portion 10, lateral movement of the insert portion 100 relative to base portion 10 is completely precluded. Each of the adjoining uprights of adjacent fence panels passes through aligned passages in both superposed insert portion 100 and base portion 10, so that in effect the anchor assembly acts as a single block.

It will also be appreciated that the anchor assembly 200 may be used for supporting the outermost upright of panels at the ends of a line of fencing panels, since an upright is individually secured in its own aligned passage through the superposed insert portion 100 and base portion 10 and does not rely for its stability in the anchor on an adjacent upright. Furthermore, the aligned passages and the fact that the formers 24 and 26 of base portion 10 are closed at their lower ends (save for the drainage hole) as described above, provide a secure lower bearing for a fence panel acting as a gate.

Yet a further advantage of the present invention resides in the smaller apertures 40 and 42 and their associated formers 41 and 43 of base portion 10, providing passages through which the previously described securing pegs 13 may be driven. By these means the anchor assembly 200 of the present invention is virtually prevented from lateral movement over the ground surface on which it is supported, and greatly aids in making the assembly significantly more resistant to tilting under lateral loads applied to the supported fence panels or when positioned on sloping ground. This facility is particularly useful for an anchor assembly positioned at a fence panel acting as a gate.

Although by providing the fence base as an anchor assembly in two superposed parts the strain and risk of injury in manipulation when erecting a temporary fence is minimised, it will be appreciated that the individual shells of the two component parts may be produced by some central moulding facility. This allows the relatively light-weight shells to be economically transported to any one of a number of regional filling facilities closer to the site at which the temporary fence is required.

It will also be appreciated that the plastic shells act to minimise damage and crumbling of the settable material, such as is commonly experienced with fence bases comprising just a concrete block. The plastic shells further provide a convenient means of supplying the anchor assembly in a variety of colours. These could include fluorescent colours as an aid to increasing visibility at night, thus minimising the risk of injury to passers by when a fence is erected adjoining a pedestrian walkway.

Modes of Use

The base portions and insert portions of previously described embodiments can be utilised in a variety of modes.

In a first preferred mode the shells for the base portions and the insert portions are produced in a first location. At this same location or near this location fence panels intended for insertion into the base portions and insert portions are produced.

Also at this same location or near this location the shells are filled with concrete or like settable material as previously described. Batches of these shells filled with concrete together with a matching number of fence panels (that is matching with the number of shells comprising the batch) are assembled together for transport by truck or like transport mechanism to a remote assembly location where the fence panels will be inserted into the concrete filled shells so as to form temporary fences as previously described. The remote assembly location may be a few kilometers or may be a few hundred kilometers from the location at which the shells are filled with concrete and the fence panels are assembled. In this mode the idea is to form batches of concrete filled shells and fence panels which, when assembled, will make up a length of temporary fencing as required specifically at a designated remote location. Hence when the batch is delivered to site at the remote location there will be the correct number of concrete filled shells to match with the correct number of fence panels.

In a second preferred mode the first mode arrangement is varied to the extent that the fence panels are assembled at a location remote from both the shell production location and the shell filling location.

In a third preferred mode the first mode arrangement is varied to the extent that the empty shells together with the fence panels are transported to a remote location. At that location the shells are filled with concrete and the fence panels are inserted into the concrete filled shells so as to form temporary fences.

The above describes only some embodiments of the present invention and modifications, obvious to those skilled in the art, can be made thereto without departing from the scope and spirit of the present invention.

The invention claimed is:

1. A method of batch assembly of temporary fence panels and anchor blocks comprising:

a. manufacturing at a first location shells of anchor blocks adapted for receipt of temporary fence panel posts therein; said anchor blocks comprising a base portion and a superposed insert portion;

b. manufacturing at a second location fence panels having posts adapted for insertion into said anchor blocks;

c. filling said shells with settable material;

d. matching predetermined numbers of said shells filled with settable material with predetermined numbers of panels thereby to form a batch matching an order for a predetermined length of temporary fence panels; and e. loading said batch on transport and transporting said batch to a remote location where said length of temporary fence panels is assembled by insertion of said posts of said panels into ones of said shells filled with settable material, wherein each of said base portion and said superposed insert portion comprises a composite of a shell open at the underside and settable material filling said shell, and wherein respective pairs of formers integral to each said shell of said base portion and said superposed insert portion, define substantially vertical pairs of passages through said base portion and said superposed insert portion, said passages arranged so that when said base portion and said superposed insert portion are assembled together, respective pairs of said passages are in vertical alignment, said passages adapted for receiving therethrough respective ends of uprights of adjacent said fence panels, said ends passing through both said superposed insert portion and said base portion when assembled.

2. The method of claim 1, wherein said settable material is concrete.

3. The method of claim 1, wherein said shell of said base portion includes a generally rectangular prism having an open rectangular base with side and end portions extending upwardly to an upper surface parallel to said rectangular base, said shell further including corner projections thrusting upwardly from said upper surface.

4. The method of claim 3, wherein said base portion has a weight when filled with said settable material in a range of 18 to 24 kilograms.

5. The method of claim 3, wherein said superposed insert portion has a weight when filled with said settable material in a range of 14 to 20 kilograms.

6. The method of claim 3, wherein said upper surface is provided with a pair of apertures disposed along a transverse centre line of said upper surface; each of said pair of apertures communicating with a respective integral former extending downwardly from an underside of said upper surface to a point approximately level with said open rectangular base.

7. The method of claim 6, wherein each said former is provided with an integral closure at said point level with said open rectangular base, said closure provided with a drainage hole.

8. The method of claim 6, wherein each of said pair of apertures and respective said formers are adapted for insertion therein as a close sliding fit of a tubular steel upright of temporary fence panel.

9. The method of claim 6, wherein each end portion of said open rectangular base is provided with a recess extending inwardly, said recess open at an underside level with said open rectangular base, said recess extending upwardly to a level intermediate said open rectangular base and said upper surface, said recess adapted for insertion of the fingers of a user for lifting of said base portion.

10. The method of claim 9, wherein apertures are provided in each said end portion, said apertures located centrally in said end portion and between said level intermediate said open rectangular base and said upper surface, said apertures communicating with integral formers extending inwardly from each said end portion such that axes of said formers are aligned, each said former coextensive in length with each said recess.

11. The method of claim 10, wherein each said aperture and each said former is adapted to receive therethrough a length of reinforcing rod passing from one said end portion to an opposite said end portion prior to said filling of said shells.

12. The method of claim 6, wherein each one of at least one pair of diametrically opposed said corner projections is provided with an aperture in an upper surface of said corner projections, said aperture communicating with an integral former extending downwardly from said upper surface to a point level with said open rectangular base, said aperture and said former adapted to receive therethrough securing pegs during assembly of said temporary fence panels.

13. The method of claim 12, wherein each of said securing pegs comprises a welded "T" shaped assembly of lengths of steel rod, the length of a leg portion of said "T" shaped assembly sufficient to extend from said upper surface of said corner projections to a preferred depth below a ground surface supporting said anchor block after assembly, the length of a cross bar portion of said "T" shaped assembly sufficient for one side of said cross bar to overlap a portion of said superposed insert portion when said securing peg is driven to said preferred depth.

14. The method of claim 6, wherein said superposed insert portion comprises a central body portion with outwardly extending opposing outer end portions, said central body portion and said outwardly extending end portions having a contiguous upper surface parallel to an underside of said central body portion, said superposed insert portion being adapted for nested engagement as a close sliding fit between said corner projections of said base portion so as to rest on said upper surface of said base portion during assembly, said base portion and said superposed insert portion when assembled forming a generally rectangular block.

15. The method of claim 14, wherein a depth of said central body portion is approximately equal to a height of said corner projections above said upper surface of said base portion after assembly.

16. The method of claim 14, wherein a depth of said opposing outer end portions is reduced relative to said central body portion so as to allow space for insertion of the fingers of a user when lifting said superposed insert portion for assembly or disassembly with said base portion.

17. The method of claim 14, wherein said upper surface of said superposed insert portion is provided with a pair of apertures disposed along a transverse centre line of said upper surface, said apertures communicating with integral formers extending downwardly from an underside of said upper surface to a point level with said underside of said central body portion.

18. The method of claim 14, wherein respective ones of said apertures and said formers are axially aligned with respective ones of said apertures and said formers of said base portion when said base portion and said superposed insert portion are assembled together, such that said apertures and said formers define a single pair of passages passing through both said superposed insert portion and said base portion.

19. The method of claim 14, wherein each of said outer end portions is provided with an aperture; each said aperture communicating with an integral former extending inwardly from each said outer end portion such that said formers are axially aligned; each said former coextensive in length with respective said outer end portions.

20. The method of claim 19, wherein each said aperture and said former of said outer end portions is adapted to receive therethrough a length of reinforcing rod extending from one said outer end portion to an opposite said outer end portion.

* * * * *